United States Patent [19]

Nakamura et al.

[11] Patent Number: 4,822,303

[45] Date of Patent: Apr. 18, 1989

[54] ELECTRICAL CONNECTOR

[75] Inventors: Masaru Nakamura; Masao Yamagauchi, both of Tokyo, Japan

[73] Assignee: Hirose Electric Co., Ltd., Tokyo, Japan

[21] Appl. No.: 186,111

[22] Filed: Apr. 25, 1988

[30] Foreign Application Priority Data

| | | | |
|---|---|---|---|
| May 18, 1987 | [JP] | Japan | 62-74160 |
| May 18, 1987 | [JP] | Japan | 62-74161 |
| Aug. 5, 1987 | [JP] | Japan | 62-119936 |
| Aug. 5, 1987 | [JP] | Japan | 62-119937 |

[51] Int. Cl.[4] ..... H01R 13/648; H01R 13/73

[52] U.S. Cl. ..... 439/607; 439/76; 439/554

[58] Field of Search ..... 439/545, 550, 554, 563, 439/63, 76, 83, 92, 79, 80, 607, 608, 609, 610

[56] References Cited

U.S. PATENT DOCUMENTS

| | | | |
|---|---|---|---|
| 4,337,989 | 7/1982 | Asick et al. | 439/609 |
| 4,379,606 | 4/1983 | Clark et al. | 439/76 |
| 4,560,226 | 12/1985 | Dennis | 439/395 |
| 4,653,837 | 3/1987 | Phillipson et al. | 439/607 |
| 4,695,115 | 9/1987 | Talend | 439/607 X |
| 4,698,025 | 10/1987 | Silbernagel et al. | 439/79 |

*Primary Examiner*—Eugene F. Desmond
*Assistant Examiner*—Stephen Zagrobelny
*Attorney, Agent, or Firm*—Takeuchi Patent Office

[57] ABSTRACT

An electrical connector includes a receptacle connector having a first insulating housing containing a plurality of first contacts and a first shielding shell disposed so as to enclose contact portions of the first contacts; a plug connector including a second insulating housing containing a plurality of second contacts and a second shielding shell disposed so as to enclose contact portions of the second contacts; and mounting means for mounting the first shielding shell on an object and defining with the first shielding shell a circumferential channel into which a front end of the second shielding shell is to be fitted. The first insulating housing has a front contact enclosure to enclose the contact portions of the first contacts; the first shielding shell has a front enclosure into which said front contact enclosure is fitted; and the mounting means has a central opening for receiving the front enclosure and a stepped edge around the central opening so as to define with the first shielding shell the circumferential channel into which the front end of the second shielding shell is to be fitted to make electrical connections between the first and second shielding shells.

11 Claims, 4 Drawing Sheets

ELECTRICAL CONNECTOR

BACKGROUND OF THE INVENTION

The present invention relates generally to electrical connectors for printed circuit board (PCB) and, mroe particularly, to an electrical connector including an insulating housing containing a plurality of substantially L-shaped contacts, front portions of which are adapted to engage mating contacts and rear portions of which extend downwardly through the insulating housing.

A variety of electrical connectors suitable for mounting on an equipment panel or PCB are well known. For example, it is known that the rear portions of contacts such as described above are bent so that their axes become substantially perpendicular to a plane of the PCB, and the rear ends are inserted into plated-through-holes (PTH) of the PCB to mount the receptacle connector in such a manner that the mating plug connector may be fitted into the receptacle connector in a plane parallel to the plane of the PCB.

The above PCB electrical receptacle connector has been assembled by bending contacts by 90 degrees either after inseration into the insulating housing or before inserting the bent contacts into the insulating housing. For this reason, an upper rear portion of the insulating housing has been cut off to handle the bent portions of the contacts. As a result, the bent portions are exposed at the cut-off portion, presenting the following problems.

(1) Since the bent portions are exposed from the insulating housing of a receptacle connector mounted on a unit or the like, dust or dirt tends to adhere to the contacts, causing poor insulation or even short circuiting across the contacts.

(2) The exposed contact portions are very easy to accidentally contact by the installing or maintenance personnel, creating a hazardous condition.

(3) The exposed contact portions impair the electromagnetic interference (EMI) shielding action of the receptacle connector.

(4) When the PCB becomes faulty, the entire electrical connector must be replaced by removing all the mounting screws. This is a very time consuming and troublesome operation when a large number of such electrical connectors are mounted on the panel.

Recently, there is the increasing use of electrical connectors with a shielding shell for enclosing the contact containing insulating housing to prevent not only electromagnetic interference (EMI) but also damage to the electrical connector caused by plugging or unplugging operations or cable load itself. As the size and weight of electronic equipment decrease, there is an increased demand for a compact and light electrical connector to be mounted on a PCB. In general, the contact portions of contacts mounted in the electrical connector may be made compact by reducing the current capacity so that it is relatively easy to reduce the size of the entire contact. In the above electrical connector, however, the shielding shells of both receptacle and plug connectors must be engaged with each other so that there is the minimum shield length for effective engagement, thus limiting reduction in the connector length.

SUMMARY OF THE INVENTION

Accordingly, it is an object of the present invention to provide a printed circuit board, electrical receptacle connector which is free from the above problem.

Another object of the invention is to provide a compact electrical connector.

According to one aspect of the invention there is provided an electrical receptacle connector for a PCB, which includes an insulating housing for holding a plurality of contacts each having a contact portion for contact with a mating contact and a substantially L-shape rear portion extending from a rear end of the contact portion; the insulating housing having a front contact enclosure for enclosing the contact portions of the contacts and a rear base plate extending from a lower rear end of the front contact enclosure, with free ends of the L-shaped rear portions passing through the rear base plate; and a shielding shell having an enclosure section for enclosing the front contact enclosure of the insulated housing and a cover section extending from an upper rear end of the enclosure section to cover at least the rear portions of the contacts.

According to another aspect of the invention there is provided an electrical receptacle connector which includes a mounting frame with a pair of first latch means for engagement with a mating plug connector; an insulating housing detachable from the mounting frame and containing a plurality of contacts therein; a pair of second latch means provided on opposite sides of the insulating housing; a first elongated guide member provided on an outside of the second latch means and extending in a direction that the insulating housing is detachable from the mounting frame; and a first latch member provided on the outside adjacent the guide member for locking the insulating housing to the mounting frame.

According to still another aspect of the invention there is provided an electrical connector which includes a receptacle connector having a first insulating housing containing a plurality of first contacts and a first shielding shell disposed so as to enclose contact portions of the first contacts; a plug connector having a second insulating housing containing a plurality of second contacts and a second shielding shell disposed so as to enclose contact portions of the second contacts; and mounting means for mounting the first shielding shell on an object and defining with the first shielding shell a circumferential channel into which a front end of said second shielding shell is to be fitted.

Other objects, features, and advantages of the invention will be apparent from the following description when taken in conjunction with the accompanying drawings.

DESCRIPTION OF THE PREFERRED EMBODIMENTS

Figure 1:
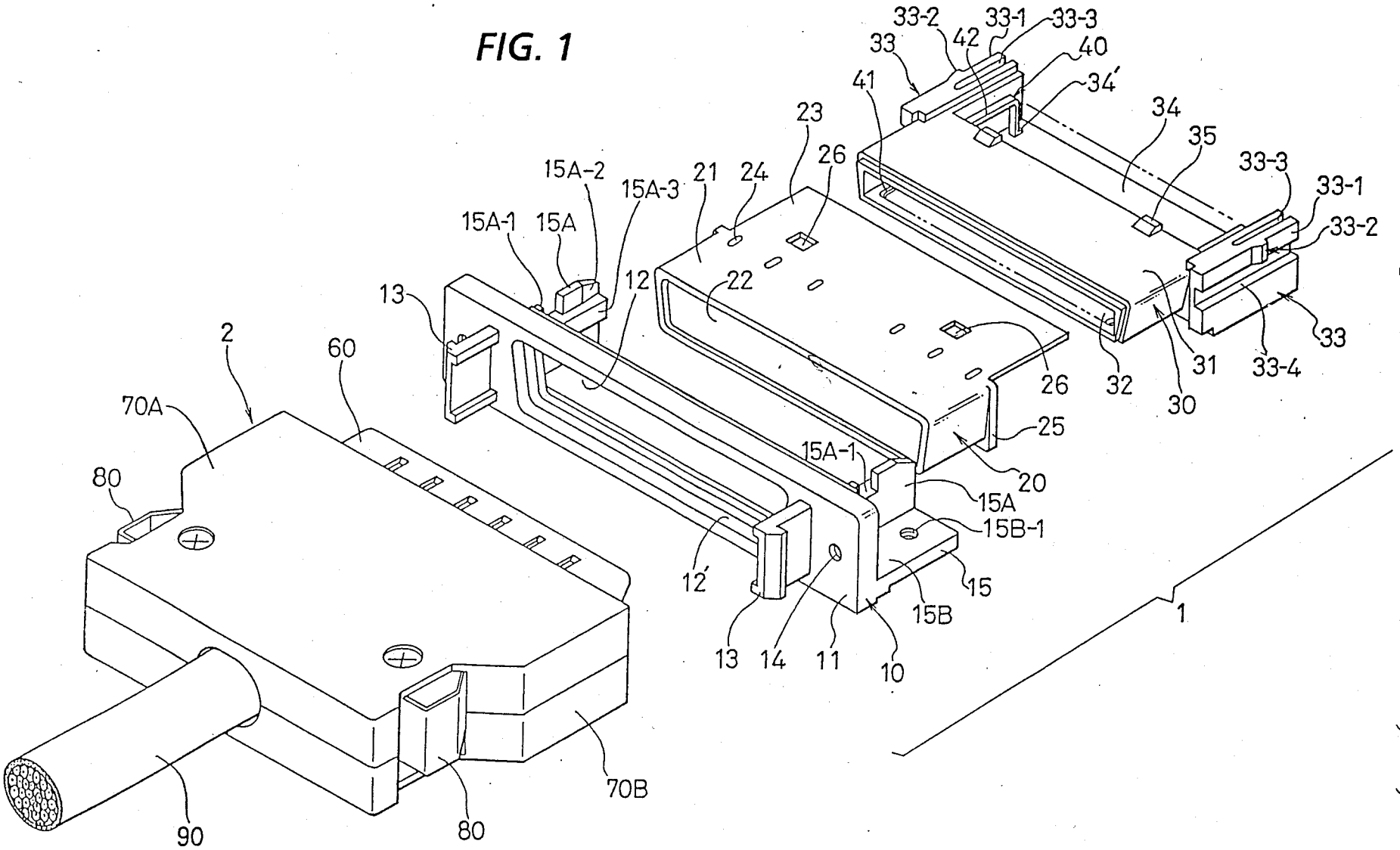
FIG. 1 is an exploded perspective view of an electrical receptacle connector with an electrical plug connector according to an embodiment of the invention.

In FIG. 1 there is shown a receptacle connector 1 adapted to mount on a PCB. The receptacle connector 1 includes a mounting frame 10 with generally L-shaped side profiles, a shielding shell 20 to be fitted into the mounting frame 10 to form a shielding housing, and an insulating housing 30 for holding a plurality of female contacts 40 in place.

The mounting frame 10, a part of the receptacle connector for receiving a mating plug connector 2, is preferably made of metal by die casting so as to have a generally rectangular front flange 11. The front flange 11 has a central mount opening 12 of an inverted substantially trapezoidal shape. The mount opening 12 is provided with an stepped edge 12'. A pair of latch arms 13 extend forwradly from the front flange 11 on opposite sides of the mount opening 12 for engagement with a pair of latch devices 80 of a mating plug connector 2. A pair of threaded holes 14 are provided on opposite sides of the front flange 11 for mount on a panel of a unit or the like with bolts or screws.

A pair of mounting legs 15 extend rearwardly from the back of the front flange 11 on opposite sides. Each mounting leg 15 has a vertical wall 15A and a horizontal wall 15B. The vertical wall 15A is adapted to engage a latch device 33 of the insulating housing 30 for integration. That is to say, the vertical wall 15A has a tapered rear portion 15A-2 and a latch recess 15A-1 adapted to engage a latch boss 33-2 of the latch device 33 to lock the insulating housing 30 to the mounting frame 10. It also has a guide rim 15A-3 on the inside for fitting into a guide groove 33-4 of the latch device 33.

The horizontal wall 15B has a threaded hole 15B-1 into which a bolt or screw is threaded to mount the receptacle connector 1 on a PCB. It is also possible to ground the mounting frame 10 to a ground conductor of the PCB through the bolt or screw.

The shielding shell 20 is formed from sheet metal so as to have a front enclosure 21 for enclosing a front contact enclosure 31 of the insulating housing 30. The front enclosure 21 has a plug receptacle 22 through which a front end of the insulating housing 30 is accessible. A rear flat cover 23 extends rearwardly from an upper rear end of the shielding shell 20 to cover the L-shaped rear portions 42 of female contacts 40 which are exposed from the insulating housing 30. A plurality of resilient bosses 24 are provided on the top of the shielding shell 20 to eliminate any play when the shielding shell 20 is inserted into the mount opening 12 of the mounting frame 10. These resilient bosses 24 also serve to electrically connect the mounting frame 10 and the shielding shell 20.

A stopper jaw 25 is provided at the lower rear end of the front enclosure 21 to abut the back of the front flange 11 of the mounting frame 10 to stop further advancement of the shielding shell into the mount opening 12 of the mounting frame 10 beyond a certain point and electrically connect the shielding shell 20 to the mounting frame 10. A pair of latch apertures 26 are provided on the top of the shielding shell behind the resilient bosses 24 to receive a pair of latch bosses 35 for locking the shielding shell 20 and the insulating housing 30.

Figure 2:
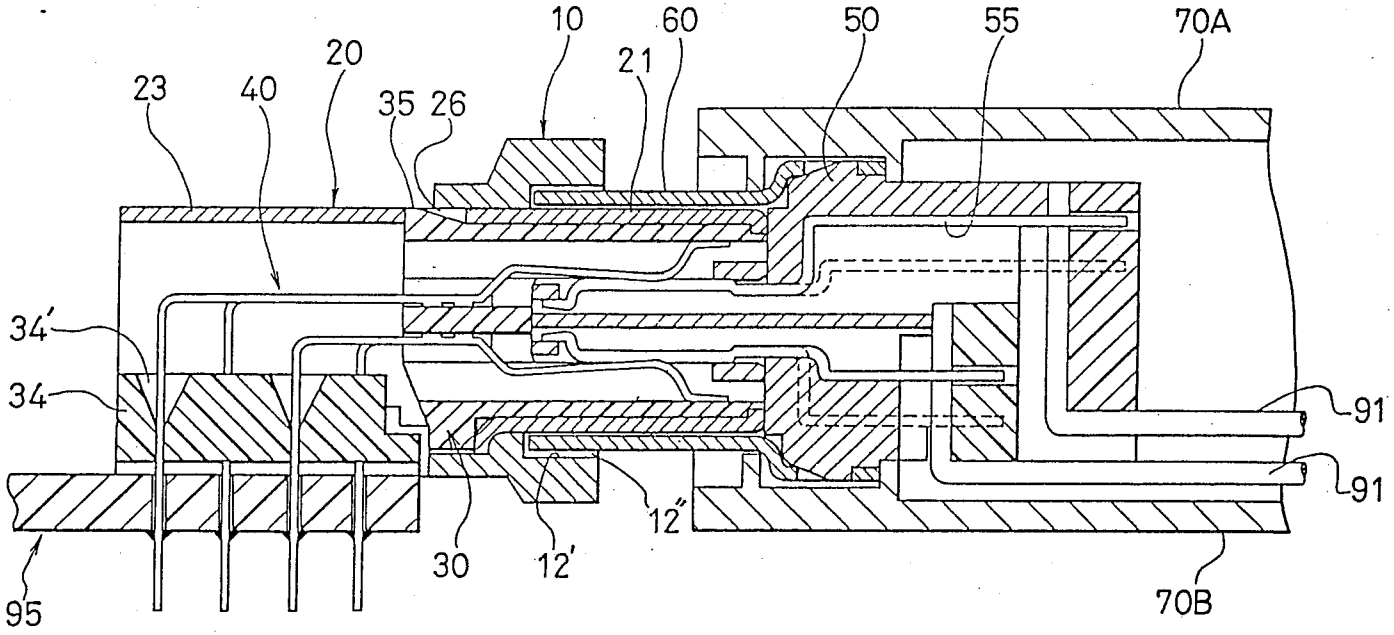
FIG. 2 is a sectional view of the plug connector plugged into the receptacle connector of FIG. 1 which is mounted on a printed circuit board.

The insulating housing 30 may be integrally made of an insulating material such as a plastic so as to have a front contact enclosure 31 with a contact receptacle 32 for receiving the plug connector 2. The front contact enclosure 31 encloses the contact portions 41 of contacts 40. A pair of latch devices 33 are provided on opposite sides of the insulating housing 30. The insulating housing 30 has a rear base plate 34 at its lower rear end. As best shown in FIG. 2, a plurality of contact receiving apertures 34' are provided on the rear base plate 34 in the same pattern as that of PTHs of a PCB 95. The rear ends 42 of female contacts 40 extend downwardly and pass through these apertures 34'. The free ends of the contacts 40 projecting from the rear base plate 34 are inserted into respective PTHs of the PCB when the receptacle connector 1 is mounted on the PCB 95.

A latch lever 33-1 is cantilevered on top of the latch device 33 with a slot 33-3. The latch lever 33-1 has a tapered latch boss 33-2 on its outside. A guide groove 33-4 is provided on the outside below the latch lever 33-1 to receive the guide rim 15A-3. A pair of tapered latch bosses 35 are provided on the upper rear edge of the front contact enclosure 31.

The plug connector 2 may be a conventional shielded plug connector and will be described briefly. In FIGS. 1 and 2, the plug connector 2 consists mainly of the insulating housing 50, a metal shell 60 for covering the contact portions of male contacts 55 which are mounted in the insulating housing 50, and a pair of case parts 70A and 70B for holding the insulating housing 50 and the metal shell 60 between them. A pair of latch devices 80 are provided on opposite sides of the case parts 70A and 70B. A cable 90 extends from the rear of the case parts 70A and 70B. The respective conductors 91 of the cable 90 are terminated to the rear portions of the corresponding male contacts 55.

A method of assembling the receptacle connector 1 will be described.

(1) The insulating housing 30 having an array of female contacts 40 is inserted into the shielding shell 20 from the back so that the latch apertures 26 of the shielding shell 20 engage the latch bosses 35 of the insulating housing 30 for locking them to form an insulating-shielding housing assembly.

(2) This assembly is then inserted into the mount opening 12 of the mounting frame 10 such that the guide rims 15A-3 may fit into the guide grooves 33-4 of the latch device 33. Consequently, the latch bosses 33-2 of the latch levers 33-1 are brought into contact with the tapered rear ends 15A-2 of the vertical walls 15A, flexing the latch levers inwardly. Finally, the latch bosses 33-2 are snapped into latch recesses 15A-1 of the vertical walls 15A to lock the insulating housing 30 to the mounting frame 10. This completes an assembly of the receptacle connector 1.

The structure in which the shielding shell 20 is inserted through the mounting frame 1 is advantageous. That is, since the shielding shell 20 and insulating housing 30 are easy to attach to or detach from the mounting frame 10, when the PCB becomes faulty, it is easy to replace the PCB without moving the mounting screws of the mount frame 10 which has been secured to a panel or the like.

As best shown in FIG. 2, there is defined a circumferential channel 12" between the stepwise extended edge 12' of the mounting frame 10 and the shielding shell 20. When the plug connector 2 is plugged into the receptacle connector 1 mounted on the PCB 95, the shielding shell 60 of the plug connector 2 is fitted into the circumferential channel 12". This tends to increase the length of the shielding shell 20 fitted into the shielding shell 60 and decreases the length of the receptacle connector 1 by that much, thus providing a compact electrical connector.

Figure 3:
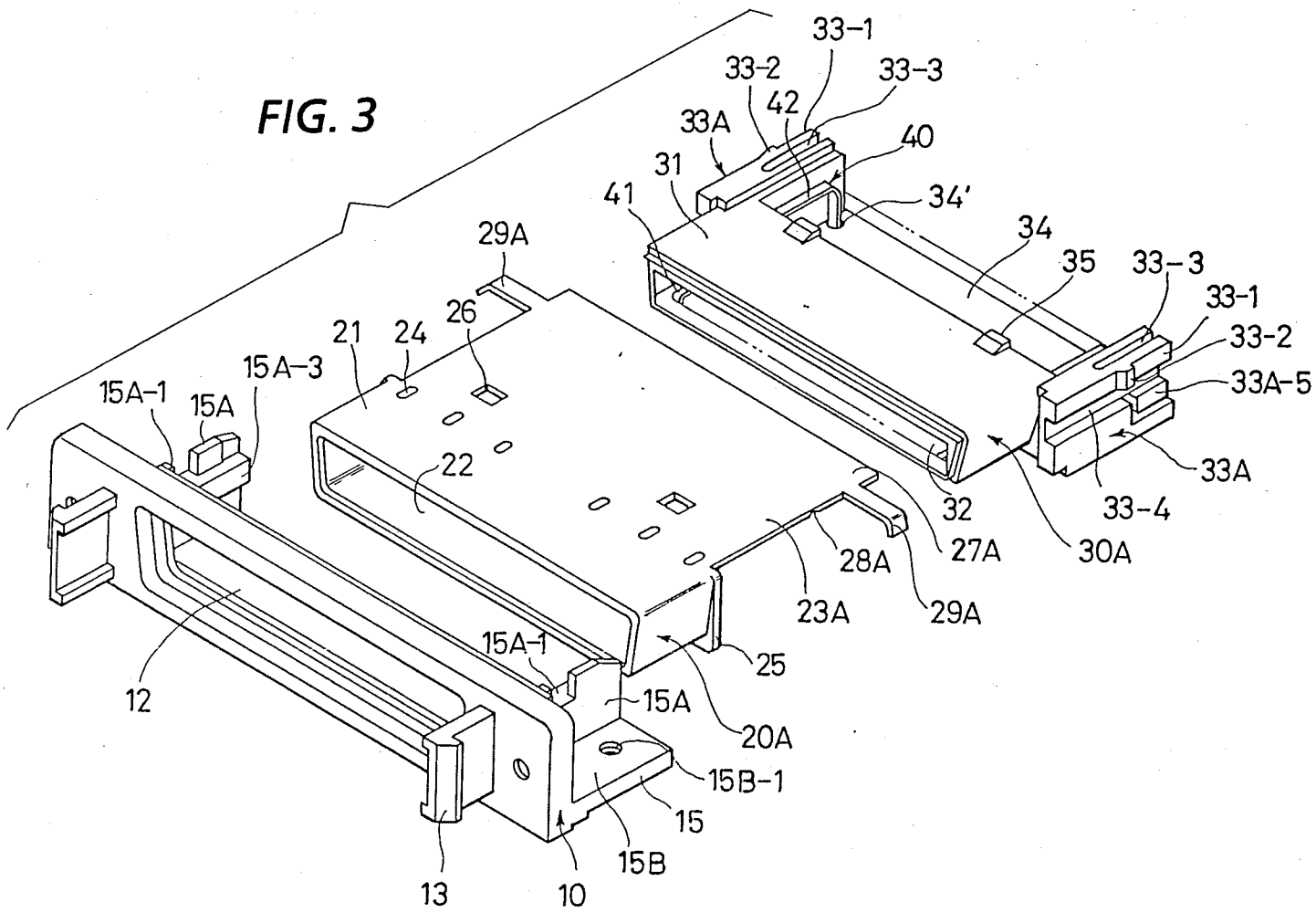
FIG. 3 is an exploded perspective view of an electrical receptacle connector according to another embodiment of the invention.
Figure 4:
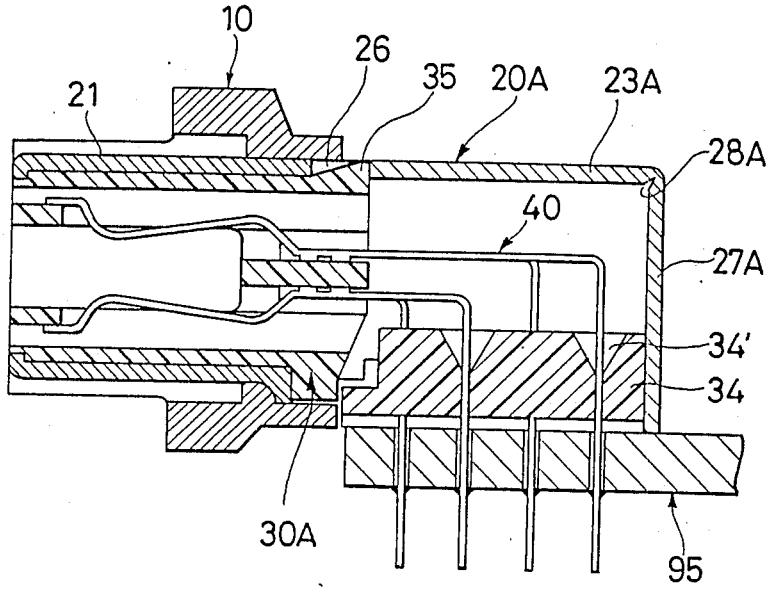
FIG. 4 a sectional view of the receptacle connector of FIG. 3 mounted on a printed circuit board.

In FIGS. 3 and 4, there is shown a PCB receptacle connector according to another embodiment of the invention. A shielding shell 20A and an insulating housing 30A are similar to those of FIGS. 1 and 2, and like reference numerals denote identical or equivalent parts or components of FIGS. 1 and 2 and repetitious description will be omitted.

As best shown in FIG. 3, the shielding shell 20A has a longer flat rear cover 23A than the rear cover 23 of FIG. 1. This rear cover 23A has a bending groove 28A along a line parallel to the rear edge. As best shown in FIG. 4, the rear cover 23A is bent by 90 degrees along this bending groove 28A to form a vertical section 27A for covering the rear portions of conacts 40. A pair of latch lugs 29A are provided on opposite lower sides of the vertical section 27A. On the other hand, a pair of latch grooves 33A-5 are provided on the both latch devices 33A.

To mount the shielding shell 20A over the insulating housing 30A, first of all, insert the insulating housing 30A into the shielding shell 20A from the back and then bend the rear cover 23 by 90 degrees along the bending groove 28A. Finally, bend the latch lugs 29A into the latch grooves 33A-5 of the latch devices 33A by means of a simple tool.

The invention has been described by way of a PCB electrical connector but it should be noted that the invention is applicable to electrical connectors of other type such as attached to an equipment panel without mounting on a PCB or not attached to any panel at all.

The electrical connector according to the invention has the following advantages.

(1) The simply structured shielding shell covers the exposed portions of contacts, thus preventing the adhesion of dirt and dust to the contacts and accidental touching by the operator as well as providing EMI shielding.

(2) The shielding shell and insulating housing are simple in structure, easy to attach or detach and assemble, low at the unit manufacturing cost, and easy to replace the insulating housing or shielding shell with a new one.

(3) With the structure shown in FIGS. 3 and 4, the rear portion of the insulating housing is covered completely with the vertical section so that there is less possibility that direct and dust adhere to the contacts. In addition, more effective EMI shielding is provided.

(4) Since the insulating housing containing contacts is detachable from the shield housing, it can be replaced without difficulty, with the shield housing attached to the equipment panel or mating connector. Consequently, when the contact-containing insulating housing becomes faulty, it can be readily replaced with a new one so that it is not necessary to discard the entire electrical connector.

(5) The front end of the shielding shell of a plug connector is fitted into the circumferential channel of the receptacle connector, ensuring the necessary length for the shielding shells to engage each other and sufficient resistance to plugging and unplugging forces and/or cable load.

(6) Since the front end of the shielding shell of the plug connector is fitted into the circumferential channel of the receptacle connector, the axial length of the receptacle connector can be decreased by that much, thus making the entire connector smaller and lighter and the mounting density on a PCB higher.

While a preferred embodiment of the invention has been described using specific terms, such description is for illustrative purposes only, and it is to be understood that changes and variations may be made without departing the spirit and scope of the invention as recited in the appended claims.

What is claimed is:

1. An electrical receptacle connector for a printed circuit board, which comprises:

a one-piece detachable insulating housing for holding a plurality of contacts each having a contact portion for engagement with a mating contact and a substantially L-shaped rear portion extending rearwardly from a rear end of said contact portion;

said insulating housing having a front contact enclosure for enclosing said contact portions of said contacts and a rear base plate extending rearwardly from a lower rear end of said front contact enclosure, with free ends of said L-shaped rear portions passing through said rear base plate;

a shielding shell having a front enclosure for enclosing said front contact enclosure of said insulating housing and a rear cover extending rearwardly from an upper rear end of said front enclosure to cover at least upper part of said rear portions of said contacts;

a mounting frame having a central opening through which said mating plug connector engages said contacts of said insulating housing completely enclosed by said shielding shell;

a pair of first releasable latch means extending rearwardly from a backside of said mounting frame on opposite sides of said central opening;

a first elongated guide member provided on an inside of said first latch means and extending in a direction that said insulating housing is detachable from said mounting frame;

a pair of mounting means each extending rearwardly from said backside of said mounting frame and outwardly from said first latch means;

a pair of second releasable latch means provided on opposite sides of said insulating housing for engagement with said first releasable latch means to lock said detachable insulating housing to said mounting frame; and a second elongated guide member provided on an outside of said second latch means for slidable engagement with said first elongated guide member.

2. The receptacle connector of claim 1, wherein said insulating housing has at least one latch boss on said front contact enclosure; and said shielding shell has at least one latch aperture in such a position that when said insulating housing is fitted into said shielding shell, said latch aperture engages said latch boss for locking said insulating housing to said shielding shell.

3. The receptacle connector of claim 1, wherein said rear cover takes the form of a flat plate to cover said rear portions of said contacts in a plane parallel to said rear base plate.

4. The receptacle connector of claim 1, wherein said rear cover has a horizontal and a vertical section forming an L-shaped cross section to cover said rear portions of said contacts in both planes which are parallel to and perpendicular to said rear base plate.

5. The receptacle connector of claim 4, wherein said L-shaped rear cover is made by bending said flat rear portion along a bending groove which has been provided on said flat rear portion.

6. The receptacle connector of claim 4, wherein said vertical section is provided with a pair of latch lugs and said rear base plate is provided on opposite sides with a pair of latch devices each provided with a latch recess for engagement with said latch lug.

7. The receptacle connector of claim 1, wherein said second latch member is made in the form of a latch lever with a latch boss provided thereon.

8. The receptacle connector of claim 7, wherein said first latch member is made in the form of a latch recesse into which said latch boss is snapped to lock said insulating housing with said mounting frame.

9. The receptacle connector of claim 1, wherein said mounting frame is integrally formed from a metallic material.

10. The electrical receptacle connector of claim 1, wherein said shielding shell is made of sheet metal.

11. A electrical connector comprising:

a receptacle conenctor including a first insulating housing containing a plurality of first contacts and a first shielding shell disposed so as to enclose contact portions of said first contacts;

a plug connector including a second insulating housing containing a plurality of second contacts and a second shielding shell disposed so as to enclose contact portions of said second contacts;

mounting means for mounting said first shielding shell on an object and defining with said first shielding shell a circumferential channel into which a front end of said second shielding shell is to be fitted;

said first insulating housing having a front contact enclosure to enclose said contact portions of said contacts;

said first shielding shell having a front enclosure into which said front contact enclosure is fitted; and said mounting means having a central opening for receiving said front enclosure and a stepped edge around said central opening so as to define with said first shielding shell said circumferential channel into which said front end of said second shielding shell is to be fitted to make electrical connections between said first and second shielding shells.

* * * * *

UNITED STATES PATENT AND TRADEMARK OFFICE

CERTIFICATE OF CORRECTION

PATENT NO. : 4,822,303

DATED : April, 18, 1989

INVENTOR(S) : Nakamura et al

It is certified that error appears in the above-identified patent and that said Letters Patent is hereby corrected as shown below:

Column 8, claim 11, line 16, after "said" insert --first--.

Signed and Sealed this

Eighteenth Day of August, 1992

*Attest:*

DOUGLAS B. COMER

*Attesting Officer*

*Acting Commissioner of Patents and Trademarks*